US005938485A

United States Patent [19]

Hotea et al.

[11] Patent Number: 5,938,485

[45] Date of Patent: Aug. 17, 1999

[54] ELECTRICAL TERMINAL

[75] Inventors: Gheorghe Hotea, Griesheim; Marianne Eva Modler, Langen, both of Germany

[73] Assignee: The Whitaker Corporation, Wilmington, Del.

[21] Appl. No.: 08/929,565

[22] Filed: Sep. 15, 1997

[30] Foreign Application Priority Data

Sep. 30, 1996 [EP] European Pat. Off. ..... 9611586

[51] Int. Cl.[6] ..... H01R 13/15

[52] U.S. Cl. ..... 439/839; 439/847; 439/850

[58] Field of Search ..... 439/833, 839, 439/842–847, 850–852, 856, 862

[56] References Cited

U.S. PATENT DOCUMENTS

| | | | |
|---|---|---|---|
| 3,550,069 | 12/1970 | Teagno et al. . | |
| 3,713,079 | 1/1973 | Dechelette . | |
| 4,351,583 | 9/1982 | Belttary . | |
| 4,772,234 | 9/1988 | Cooper | 439/851 |
| 5,653,616 | 8/1997 | Hotea | 439/851 |
| 5,741,163 | 4/1998 | Hotea | 439/852 |

FOREIGN PATENT DOCUMENTS

| | | |
|---|---|---|
| 0 114 187-B1 | 1/1990 | European Pat. Off. . |
| 0 363 170-A2 | 4/1990 | European Pat. Off. . |
| 0 364 104-A2 | 4/1990 | European Pat. Off. . |
| 0 402 792-B1 | 12/1990 | European Pat. Off. . |
| 0 407 249-A1 | 1/1991 | European Pat. Off. . |
| 0 607 902-A2 | 7/1994 | European Pat. Off. . |
| 0 700 122-A2 | 3/1996 | European Pat. Off. . |
| 0 736 930-A1 | 10/1996 | European Pat. Off. . |
| 34 24 072-A1 | 1/1986 | Germany . |
| WO 89/05531 | 6/1989 | WIPO . |

*Primary Examiner*—Steven L. Stephan
*Assistant Examiner*—Brian J. Biggi
*Attorney, Agent, or Firm*—Driscoll Nina

[57] ABSTRACT

An electrical terminal having a contact-making region for making contact with a complementary contact pin and having a connecting region for connection to an electrical conductor is described, the contact-making region including an inner contact-making spring and an outer, external spring, the contact-making spring merging into a connecting region and having at least two mutually opposite contact spring arms which are supported by the external spring, the terminal further including a web which runs transversely with respect to the insertion direction is cut out on two longitudinal sides at least on a side of the external spring opposite the contact spring arms, this web being bent inwards in such a manner that it presses from the outside onto the contact spring arm.

20 Claims, 6 Drawing Sheets

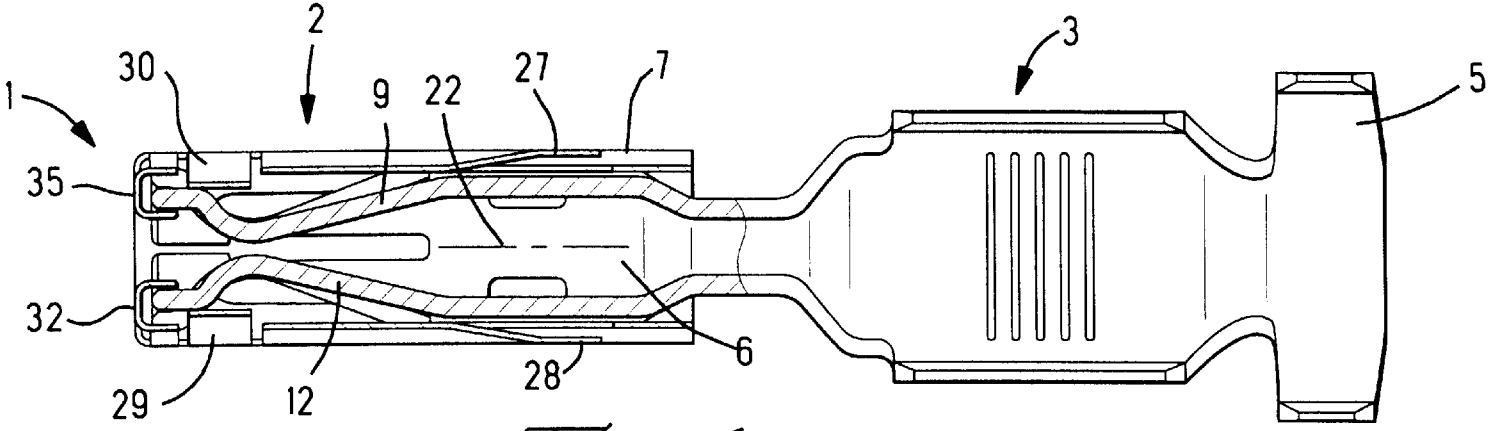
FIG. 4 B-B
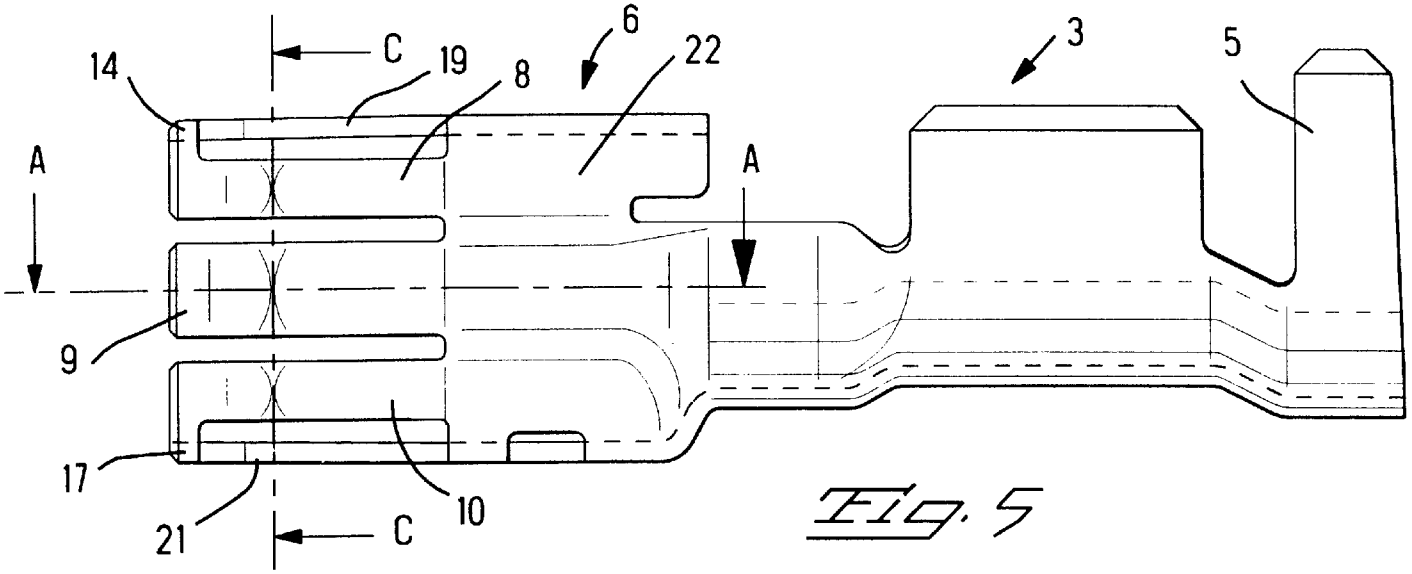
FIG. 5

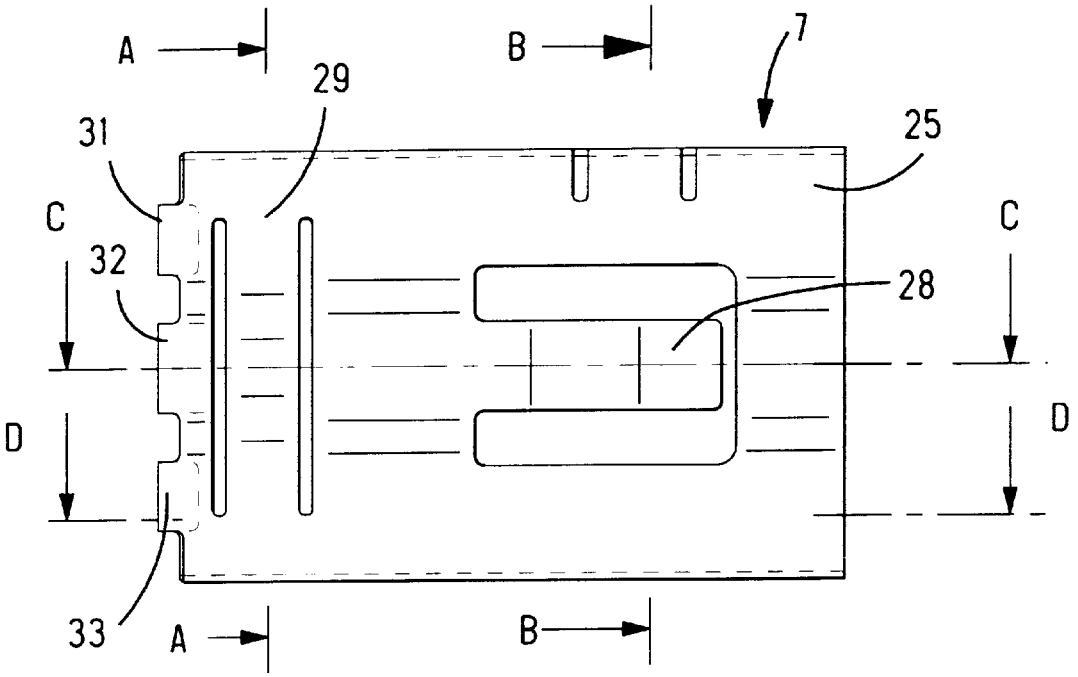
Fig. 9
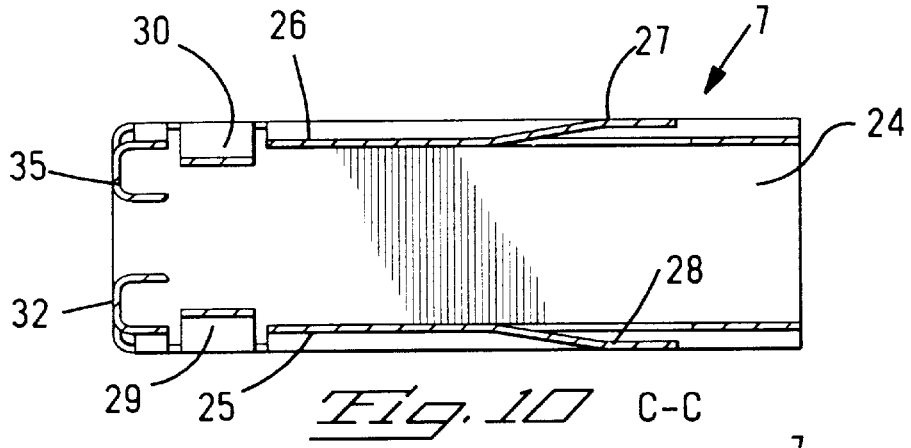
Fig. 10 C-C
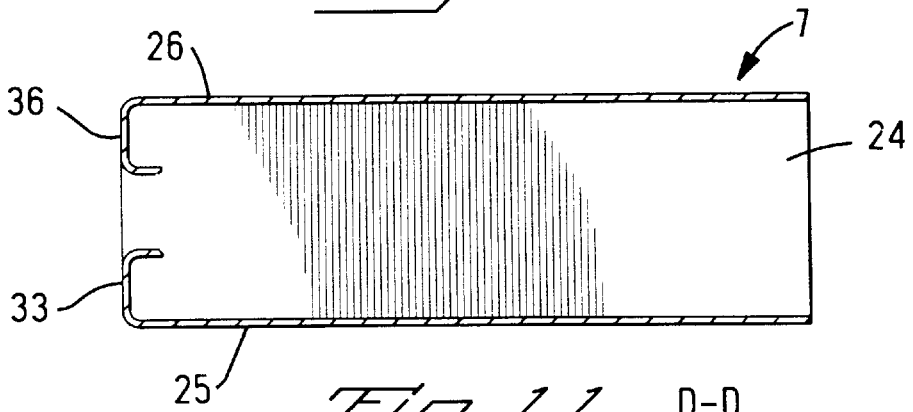
Fig. 11 D-D

B-B

A-A

ELECTRICAL TERMINAL

BACKGROUND OF THE INVENTION

1. Field of the Invention

The invention relates to an electrical terminal having a contact-making region for making contact with a complementary contact pin and having a connecting region for connection to an electrical conductor.

2. Description of the Prior Art

An electrical connecting terminal having a contact-making region for making contact with a complementary contact pin or tab and having a connecting region for connection to an electrical conductor, the contact-making region having an inner contact-making spring and an outer, external spring, the contact-making spring, which merges into the connecting region, having at least two mutually opposite contact spring arms which are supported by the external spring, is known from EP 700 122 A2. This electrical connecting terminal has in each case three pairs of contact spring arms, the outer contact spring arms each being connected to a side arm of the contact-making spring and being supported by the latter, and the centre contact spring arm in each case having a free end and not being supported. This results in the contact spring arms having different contact forces. If the contact forces of the inner contact spring arm are insufficient, then a support is required for it.

A double flat spring contact having an external spring is known from EP 114 187, the external spring having external spring bracket arms which run parallel to the contact spring arms of the double flat spring contact and press onto these contact spring arms from the outside. The external spring bracket arms in this case run essentially in the insertion direction and have free ends towards the end face.

SUMMARY OF THE INVENTION

The object of the invention is to specify an electrical connecting terminal in which the contact spring arms are supported by an external spring. The object is achieved by an electrical terminal comprising a contact-making region for making contact with a complementary contact pin or tab and having a connecting region for connection to an electrical conductor, the contact-making region having an inner contact-making spring and an outer, external spring, the contact-making spring, which merges into the connecting region, having at least two mutually opposite contact spring arms which are supported by the external spring, the terminal further comprising a web which runs transversely with respect to the insertion direction cut out at least on one side of the external spring opposite the contact spring arms, this web being bent inwards in such a manner that it presses from the outside onto the contact spring arm.

In many applications, it is necessary for the contact spring arms of an electrical connecting terminal to be supported by the external spring as well. As is known, for example from EP 114 187, such support can be provided by external spring bracket arms which run essentially parallel to the insertion direction. This results in an external spring whose shape is very irregular and uneven. However, the current trend is to produce external springs which are as smooth as possible. The solution according to the invention, of cutting out a web which runs at right angles to the insertion direction, produces a considerably smooth external surface.

It is possible in this case for the web to be cut out only on the longitudinal sides, and thus to support a contact spring arm. Alternatively, it is possible to split the web into two tongues whose free ends press jointly or in each case onto a contact spring arm.

An electrical connecting terminal according to the invention can be provided, for example, for being fitted into a chamber in a plastic housing. It is normal to provide the external spring with latching spring tongues for this purpose, which make it possible for the connecting terminal to be latched in the housing.

According to the invention, it is particularly advantageous that the latching spring tongue can be fitted on the same side of the external spring as the web, since the latter occupies only a small amount of space.

The electrical connecting terminal may have, in its connection region, either two crimping regions or else one or more insulation-piercing terminal regions for making contact with an electrical conductor.

It is particularly advantageous to use the arrangement according to the invention for an electrical connecting terminal having three pairs of contact spring arms, the centre contact spring arm in each case being supported by a web of the external spring.

BRIEF DESCRIPTION OF THE DRAWINGS

FIG. 4 shows a section through the electrical terminal along the section line BB;

FIG. 5 shows a side view of the inner contact-making spring;

FIG. 9 shows an external spring according to the invention;

FIG. 10 shows a section along the section line CC through the external spring according to the invention;

FIG. 11 shows a section along the section line DD through the external spring according to the invention;

DETAILED DESCRIPTION OF THE PREFERRED EMBODIMENT

Figure 1:
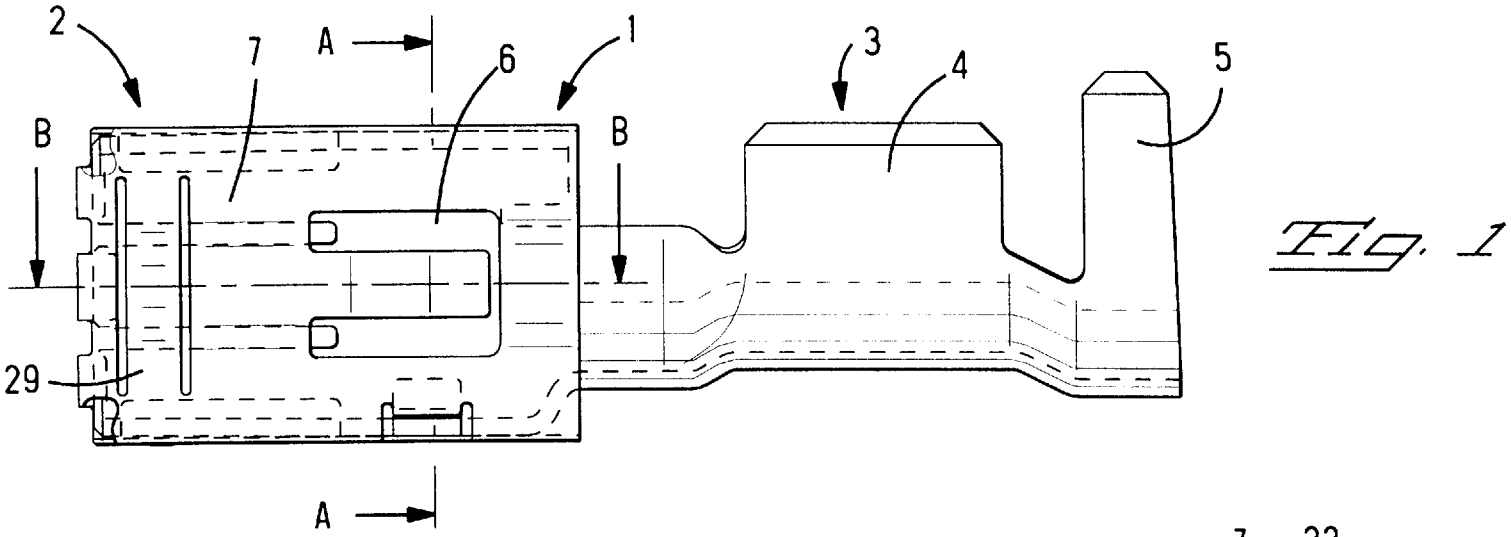
FIG. 1 shows a side view of an electrical terminal.
Figure 3:
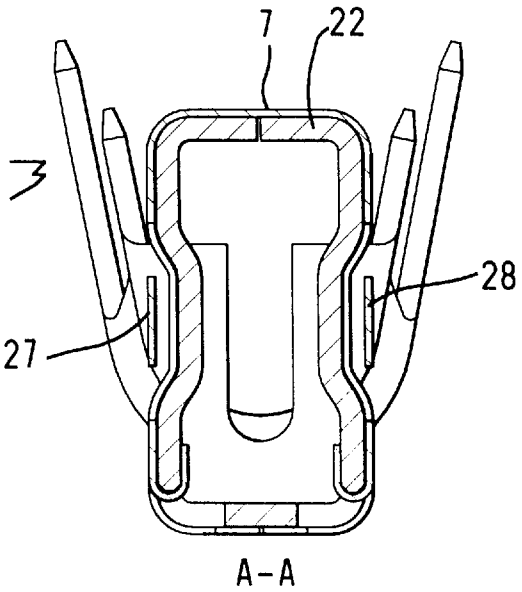
FIG. 3 shows a section through the electrical connecting terminal from FIG. 1 along the section line AA.
Figure 2:
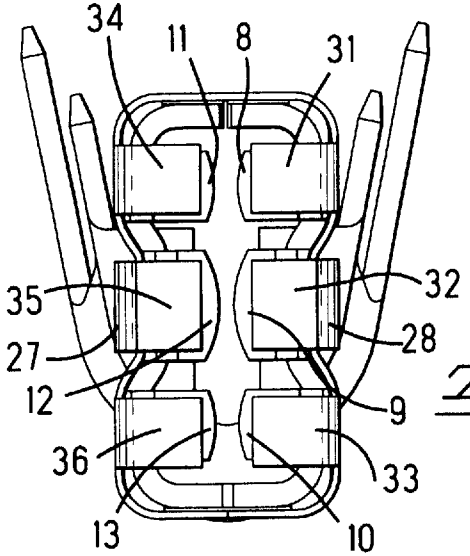
FIG. 2 shows a view of the end face of the electrical terminal.

FIG. 1 shows a side view of an electrical terminal 1 according to the invention. The electrical terminal 2 has a contact-making region 2 for making contact with a complementary contact pin or tab, for example a blade contact. Furthermore, the electrical connecting terminal 1 has a connecting region 3 which, in the present exemplary embodiment, comprises two crimping regions 4 and 5. Each crimping region 4, 5 has two opposite crimping lugs which are bent inwards appropriately during crimping. The crimping region 4 which is adjacent to the contact-making region 2 is suitable for being crimped onto an electrical conductor, and the second crimping region, which is adjacent to it, is suitable for crimping onto the insulation of an electrical conductor. In other embodiments, it is possible to provide insulation-piercing terminal connections, for example, instead of such crimping regions for making contact with an electrical conductor.

Figure 8:
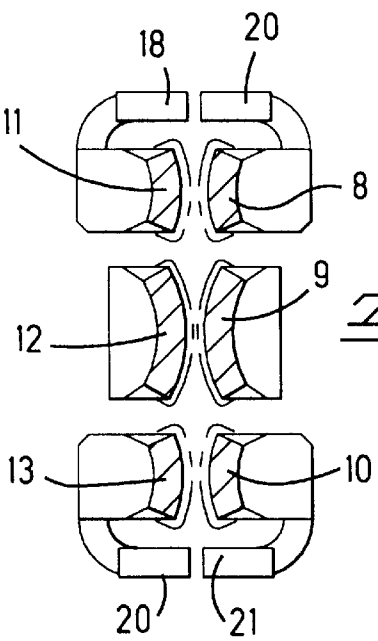
FIG. 8 shows a section along the line CC from FIG. 5 of the inner contact-making spring.

The contact-making region 2 comprises an inner contact-making spring 6 and an outer external spring 7. The contact-making spring 6 will now be described, first of all, with reference to FIGS. 5 to 8. As can easily be seen from FIGS. 5, 7 and 8, the contact-making spring has three pairs of mutually opposite contact spring arms 8 to 13. The centre contact spring arms 9 and 12 in this case have a free end. Opposite this, the respectively outer contact spring arms 8, 10, 11 and 13 are connected via a connection 14–17 on the end-face end to side arms 18–21 which support the contact spring arms 8, 10, 11 and 13. As can be seen particularly easily in FIG. 6, the contact spring arms 8–13 run towards one another as far as the contact-making point K, and then diverge. This forms an insertion opening for the complementary contact pin.

Figure 6:
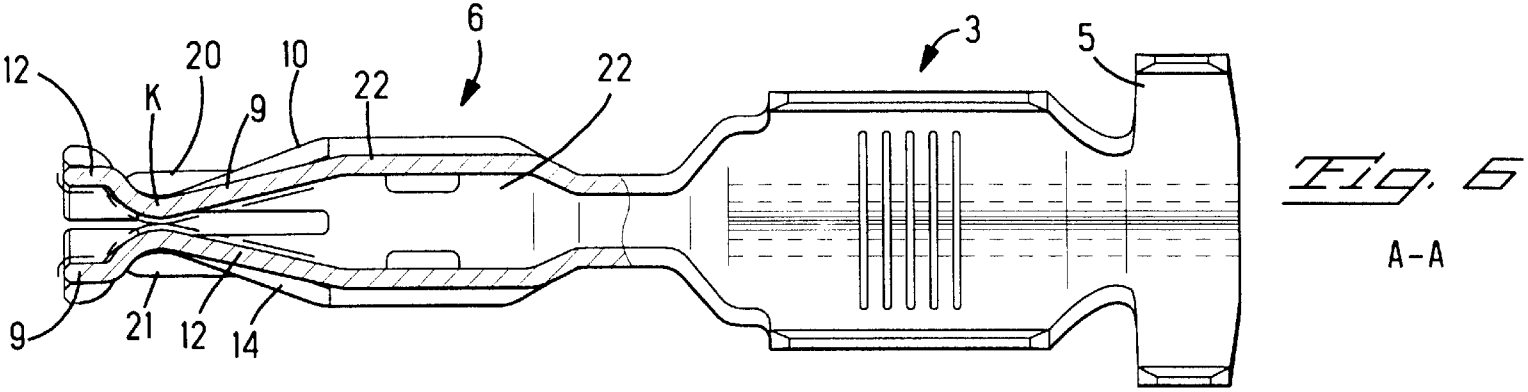
FIG. 6 shows a cross-section along the line AA of the inner contact-making spring.
Figure 7:
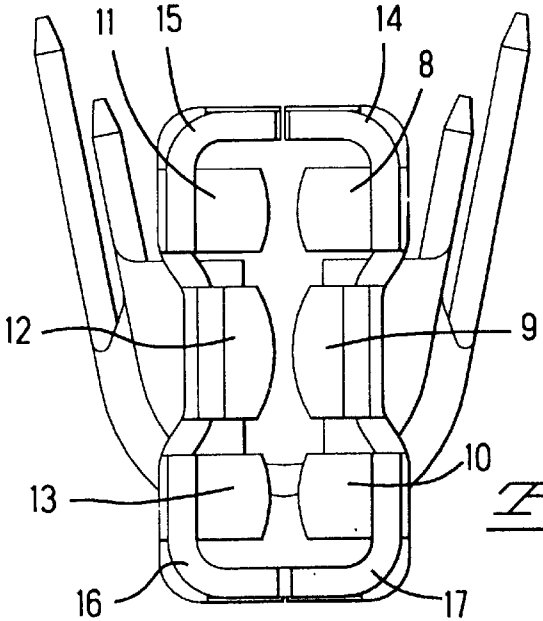
FIG. 7 shows a view of the end face of the inner contact-making spring.
Figure 14:
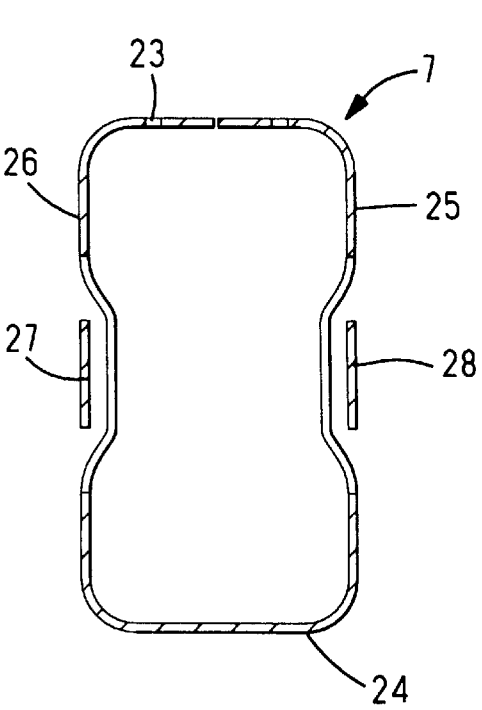
FIG. 14 shows a section along the section line BB through the external spring.
Figure 13:
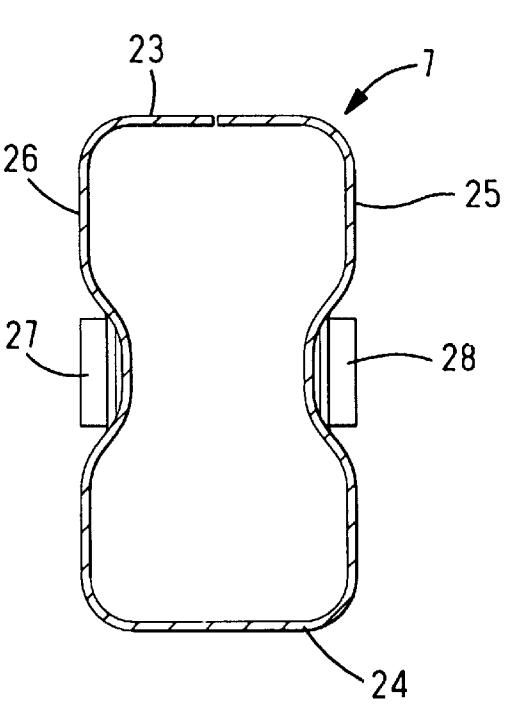
FIG. 13 shows a section along the section line AA through the external spring.
Figure 12:
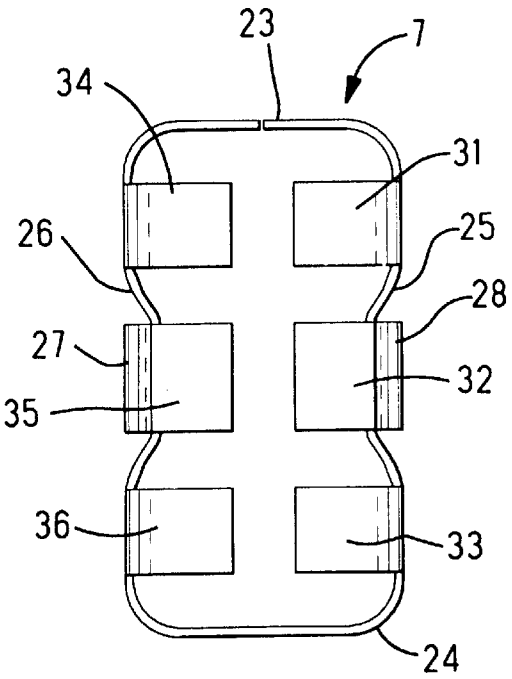
FIG. 12 shows a view of the end face of the external spring.

As can be seen from FIGS. 5 and 6, the inner contact-making spring 6 has a spring arm base 22 which is designed essentially in a box-shape. However, this box tapers in the centre region of the longitudinal sides, that is to say in the region of the centre contact spring arms 9 and 12. This can be seen particularly easily in FIGS. 7 and 8.

The external spring 7 will now be described with reference to FIGS. 9 to 14. The external spring is constructed essentially in a box-shape. It has a top wall 23 and a bottom wall 24, as well as two side walls 25 and 26. The cross-section of the external spring tapers in the centre region of the side walls. The cross-section looks like a zero (0) which has been compressed in the centre. A latching spring tongue 27, 28 is arranged on each side in this region. This latching spring tongue is used for latching the external spring in a housing. The latching spring tongue 27, 28 is a tongue that has been cut out of a side wall 25, 26. As can be seen, this latching spring tongue is detached from the housing, but does not project beyond the maximum width of the external spring. This means that the surface of the external spring is as smooth as possible. When a contact is inserted, with this external spring, through a common seal, the common seal is thus not damaged by the latching spring tongue.

Figure 15:
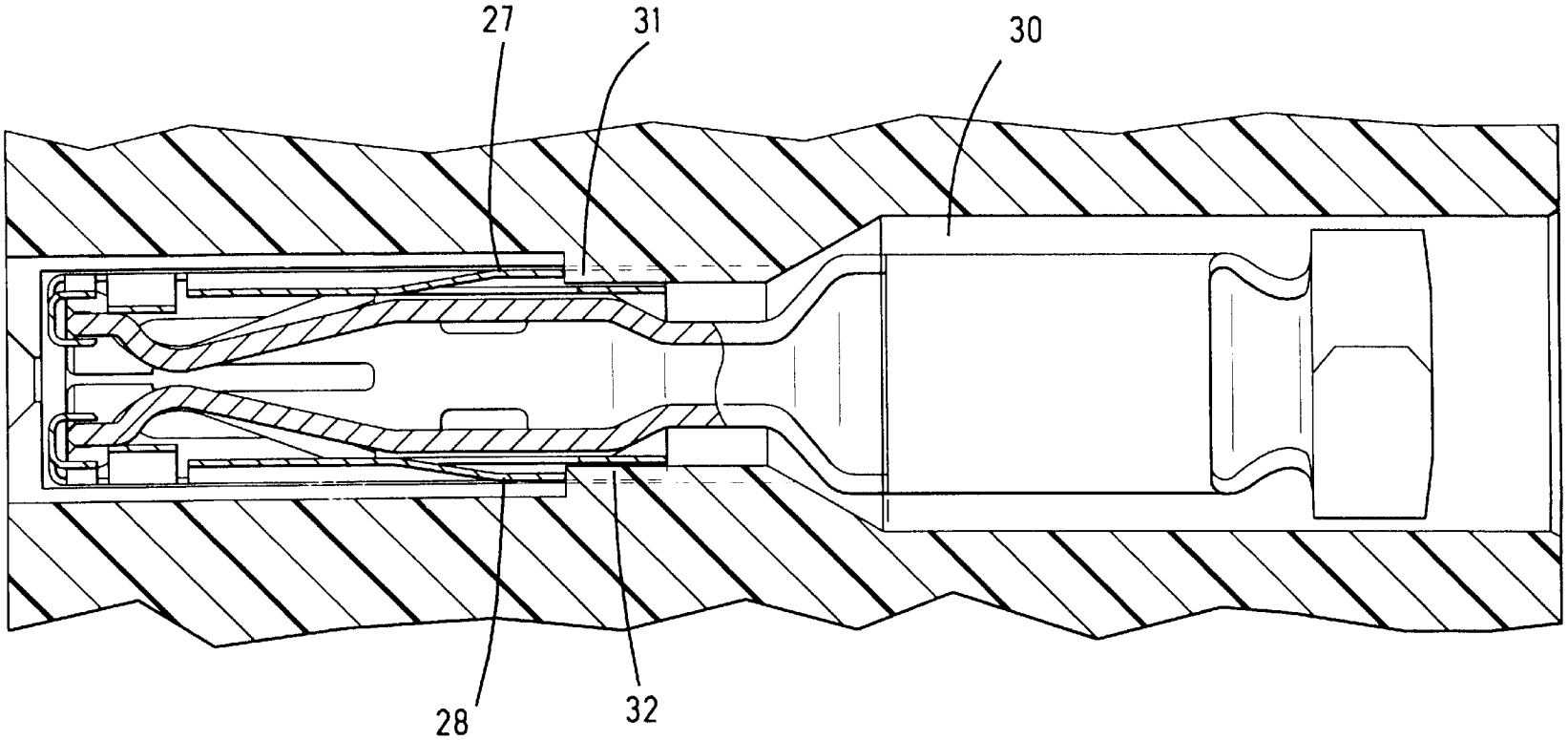
FIG. 15 shows a section through a housing with a fitted contact according to the invention.

FIG. 15 shows a section through a housing chamber 30 with a contact fitted. Two shoulders 31, 32 can be seen, behind which the latching spring tongues 27, 28 latch. The shoulders 31, 32 do not extend over the entire width of the chamber 30, but only in the centre region, in which the contact or the external spring 7 has the taper.

In the region close to the end surface, the external spring 7 furthermore has in each case one web 29, 30 in the side walls, the longitudinal axis of which web runs at right angles to the insertion direction, and which web is cut out on two longitudinal sides.

The webs 29 and 30 are both bent inwards, projecting further into the external spring than the tapered region. This can be seen in particular in FIG. 10. Furthermore, the external spring 7 has stop lugs 31 to 36 bent around on the end face, which lugs carry out the following functions:

First of all, these lugs ensure that, when a complementary contact pin is inserted, this contact pin cannot be fitted alongside, but only between, the contact spring arms.

Secondly, they ensure that the contact spring arms in the electrical connecting terminal are prestressed, which ensures a reduced insertion force and an insertion force which does not start until later, as well as a defined spring force.

The prestressed position can be seen particularly easily in FIG. 4, which shows a section through an electrical connecting terminal having an external spring. In this figure, it is possible to see not only that the stop lugs 35 and 32 ensure that the centre contact spring arms 9 and 12 are prestressed, but also that these contact spring arms are supported by the webs 29 and 30.

We claim:

1. An electrical connecting terminal comprising a contact-making region for making contact with a complementary contact pin or tab and having a connecting region for connection to an electrical conductor, the contact-making region having an inner contact-making spring and an outer, external spring, the contact-making spring, which merges into the connecting region, having at least two mutually opposite contact spring arms which are supported by the external spring, the terminal further comprising a web which runs transversely with respect to an insertion direction cut out at least on one side of the external spring opposite the contact spring arms, this web being bent inwards in such a manner that it presses from the outside onto the contact spring arm.

2. The electrical terminal according to claim 1, wherein the web is cut out on two longitudinal sides.

3. The electrical terminal according to claim 1, wherein the web is split transversely in the centre and forms two tongues which jointly press on a contact spring arm or each of which presses onto a separate contact spring arm.

4. The electrical terminal according to claim 1, wherein the webs are provided on opposite sides of the external spring.

5. The electrical terminal according to claim 1, wherein the inner contact-making spring has a box-shaped spring arm base and at least two mutually opposite contact spring arms which extend forwards toward a complementary contact mating end.

6. The electrical terminal according to claim 1, wherein the contact spring arms run towards one another as far as the contact-making point and then run away from one another again, the web pressing onto the contact spring arm in front (in the insertion direction) of the contact-making point.

7. The electrical terminal according to claim 1, wherein three pairs of contact spring arms are provided, the centre contact spring arm in each case being supported by a web.

8. The electrical terminal according to claim 7, wherein contact spring arms are on either side of the centre contact spring arm each supported by side arms of the inner contact-making spring.

9. The electrical terminal according to claim 1, wherein the contact spring arms are prestressed by stop lugs which are bent around an end-face of the external spring and engage behind the free ends of the contact spring arms.

10. The electrical terminal according to claim 1, wherein an excess length of the web, is produced by embossing.

11. The electrical terminal according to claim 1, wherein the connecting terminal is manufactured from two parts.

12. The electrical terminal according to claim 1, wherein the external spring has at least one latching spring tongue, arranged on the same side of the external spring as the web.

13. The electrical terminal according to claim 1, wherein the external spring is constructed essentially in a box-shape and, in the cross-section at right angles to the insertion direction between the side walls, has a taper which extends in the insertion direction.

14. The electrical terminal according to claim 13, wherein a latching spring tongue is provided on the external spring in the region of the taper.

15. The electrical terminal according to claim 14, wherein the external spring has a latching spring tongue on each opposite side in the region of the taper.

16. The electrical terminal according to claim 15, wherein the latching spring tongues do not project beyond the maximum width of the external spring.

17. The electrical terminal according to claim 14, wherein the latching spring tongue does not project beyond the maximum width of the external spring.

18. An electrical terminal comprising an inner contact having a base from which a pair of mutually opposite contact spring arms extend that converge towards one another to a contact making point, for engaging a mating terminal, then diverging outward to form an insertion opening; and an external spring overlying the inner contact along the contact spring arms and being affixed to the inner contact, the external spring incorporating a resilient web that is oriented transverse to the respective contact spring arm, whereby upon insertion of the mating tab the contact spring arm is deflected outward and the web cooperates therewith to enhance the spring force thereof.

19. The electrical terminal of claim 18, wherein the web is a longitudinal strip joined to the box at each end and separated therefrom by slits along the length of the web.

20. The electrical terminal of claim 19, wherein the web is deformed inward between the joined ends.

* * * * *